US009179820B2

(12) United States Patent
Mufson

(10) Patent No.: US 9,179,820 B2
(45) Date of Patent: Nov. 10, 2015

(54) FOOTWEAR CLEANING DOORMAT

(76) Inventor: Wyatt Mufson, Newton, MA (US)

( * ) Notice: Subject to any disclaimer, the term of this patent is extended or adjusted under 35 U.S.C. 154(b) by 164 days.

(21) Appl. No.: 13/239,085

(22) Filed: Sep. 21, 2011

(65) Prior Publication Data

US 2013/0067668 A1 Mar. 21, 2013

(51) Int. Cl.
*A47L 23/00* (2006.01)
*A47L 23/02* (2006.01)
*A47L 23/20* (2006.01)

(52) U.S. Cl.
CPC ..... *A47L 23/02* (2013.01); *A47L 23/00* (2013.01); *A47L 23/20* (2013.01); *A47L 23/205* (2013.01)

(58) Field of Classification Search
CPC ..... A47L 23/00; A47L 23/02; A47L 23/20; A47L 23/205
USPC ..... 15/97.2, 36
See application file for complete search history.

(56) References Cited

U.S. PATENT DOCUMENTS

| | | | | |
|---|---|---|---|---|
| 4,118,818 | A * | 10/1978 | Holleran | 15/36 |
| 4,432,112 | A * | 2/1984 | Muller et al. | 15/36 |
| 4,922,578 | A * | 5/1990 | Miettinen | 15/36 |
| 5,418,996 | A * | 5/1995 | Chen | 15/36 |
| 5,617,646 | A * | 4/1997 | Viscuso | 34/60 |
| 6,067,688 | A | 5/2000 | West | |
| 6,108,855 | A * | 8/2000 | DeLeon | 15/209.1 |
| 7,725,974 | B2 | 6/2010 | Hughes | |
| 8,631,533 | B1 * | 1/2014 | Gulian et al. | 15/36 |
| 2002/0178528 | A1 | 12/2002 | Koch | |
| 2006/0246798 | A1 | 11/2006 | Reneker et al. | |
| 2008/0104782 | A1 * | 5/2008 | Hughes | 15/30 |
| 2008/0173658 | A1 * | 7/2008 | Ronning | 220/825 |
| 2008/0256728 | A1 | 10/2008 | Feeg et al. | |
| 2009/0139017 | A1 | 6/2009 | Anderson | |
| 2010/0306935 | A1 * | 12/2010 | De Florian et al. | 15/30 |
| 2011/0252585 | A1 * | 10/2011 | Lee | 15/30 |
| 2012/0167338 | A1 * | 7/2012 | Williams | 15/380 |

FOREIGN PATENT DOCUMENTS

| | | | | |
|---|---|---|---|---|
| WO | WO-2007140218 | A2 | 12/2007 | |
| WO | WO-2009/088379 | A1 | 7/2009 | |
| WO | WO 2009088379 | A1 * | 7/2009 | A47L 23/26 |

* cited by examiner

*Primary Examiner* — Monica Carter
*Assistant Examiner* — Stephanie Berry
(74) *Attorney, Agent, or Firm* — Wilmer Cutler Pickering Hale and Dorr LLP

(57) ABSTRACT

A doormat for the enhanced cleaning of footwear. Exemplary embodiments include a doormat capable of hands free cleaning and drying of footwear, comprising a cleaning stage and a drying stage. Stepping onto the cleaning stage of the mat releases a cleaning fluid onto rotating sponges, which physically clean footwear while applying a cleaning solution. Stepping into the drying stage of the mat dries the footwear. The cleaning mat may also further comprise a supplemental cleaning stage and/or supplemental drying stage.

16 Claims, 6 Drawing Sheets

FOOTWEAR CLEANING DOORMAT

TECHNICAL FIELD

The instant disclosure is directed towards systems and methods for cleaning footwear.

BACKGROUND

People utilize footwear with great frequency in order to protect the feet from surfaces while they walk. This protection allows one to walk across rough, sharp, hot, cold, and otherwise dangerous or uncomfortable terrain. Furthermore, this protection keeps dirt, chemicals, pathogens, and other undesirable or dangerous substances from contacting the foot.

Footwear is also useful in reducing impact to the feet and providing adequate support and comfort to ensure proper form while walking or running. As footwear is worn, it is exposed to a variety of contaminants including things such as dirt, mud, fecal matter, construction waste, garbage, or other noxious substances. As footwear is generally worn every day, as people go into and out of different establishments or spend time outdoors, footwear becomes soiled. These contaminants are then brought into homes or other buildings when a person wearing soiled footwear enters.

Current doormat technology does not allow for adequate and convenient cleaning of footwear, in particular shoes and boots. Doormats in general use are of the type where one physically wipes the sole of the foot on a rough or textured surface. Other types of doormats utilize sticky surfaces to pull dirt off the bottom of the footwear. While this will physically remove larger dry particulates, such sticky mats cannot clean wet messes and also quickly lose their effectiveness. Sticky mats may also leave residue behind on the footwear. Neither of these types of doormats are capable of actually washing or sanitizing the footwear.

There are some doormats which allow for scrubbing of the footwear, but these devices are bulky and not practical for use in household settings or in other places where space is limited. Some also require the use of hands in order to fully clean the footwear, which may end up spreading contaminants or dirt to the hands.

In light of this, it can be appreciated that there exists a continuing need for a new and improved doormat that can adequately clean and sanitize footwear, without the use of hands, to prevent germs and dirt from entering the home or other interior space and prevent contamination of the hands, while having a low profile and substantially internalized components.

SUMMARY OF THE INVENTION

A cleaning doormat capable of cleaning footwear is disclosed. The doormat can be activated by hands free methods and allows for proper cleaning and sanitization of footwear. This protects the interior environment of the home or other facilities, such as clean rooms, manufacturing facilities, hospitals, or any other area where cleanliness or sterility is desired. Dirt, germs, and other contaminants are removed, such that when entering an area, the shoes do not carry undesirable substances, pathogens, or odors into said area.

In some embodiments, the footwear cleaning and sanitizing device includes a sanitizing stage having one or more sponges. The sponges are attached to a motor or other means for rotating the sponges. The sponges are supplied with cleaning fluid held in a reservoir. A first sensor, switch, or other activation mechanism causes the cleaning fluid to be applied to the sponges and causes the sponges to rotate. In some embodiments, a pump is used to cause the fluid to flow from the reservoir, through tubes, to the sponges.

Depending on the type of cleaning fluid used, different degrees of cleanliness can be achieved. Antibacterial or sterilizing fluids can be used, as can water, when sterilization is not necessary and the doormat is used only for the removal of surface dirt. Water may also be used for footwear that is too delicate to be exposed to solvents or other types of cleaning fluids. In some embodiments, there is a supplemental cleaning stage which allows for further cleaning of the footwear.

In some embodiments, the doormat is activated and cleans and sanitizes the footwear without the operator needing use of the hands. A drying stage having a vacuum, heater, fan, or other drying mechanism may be automatically activated after the conclusion of the cleaning stage, or may activated by a second activation mechanism. The drying stage may last a preset period of time, or for as long as the individual is standing on the drying stage, depending on the configuration and desired performance of the embodiment. A supplemental drying stage may also be included to remove any remaining cleaning fluid left behind on the footwear after the drying stage.

DETAILED DESCRIPTION

Figure 1A:
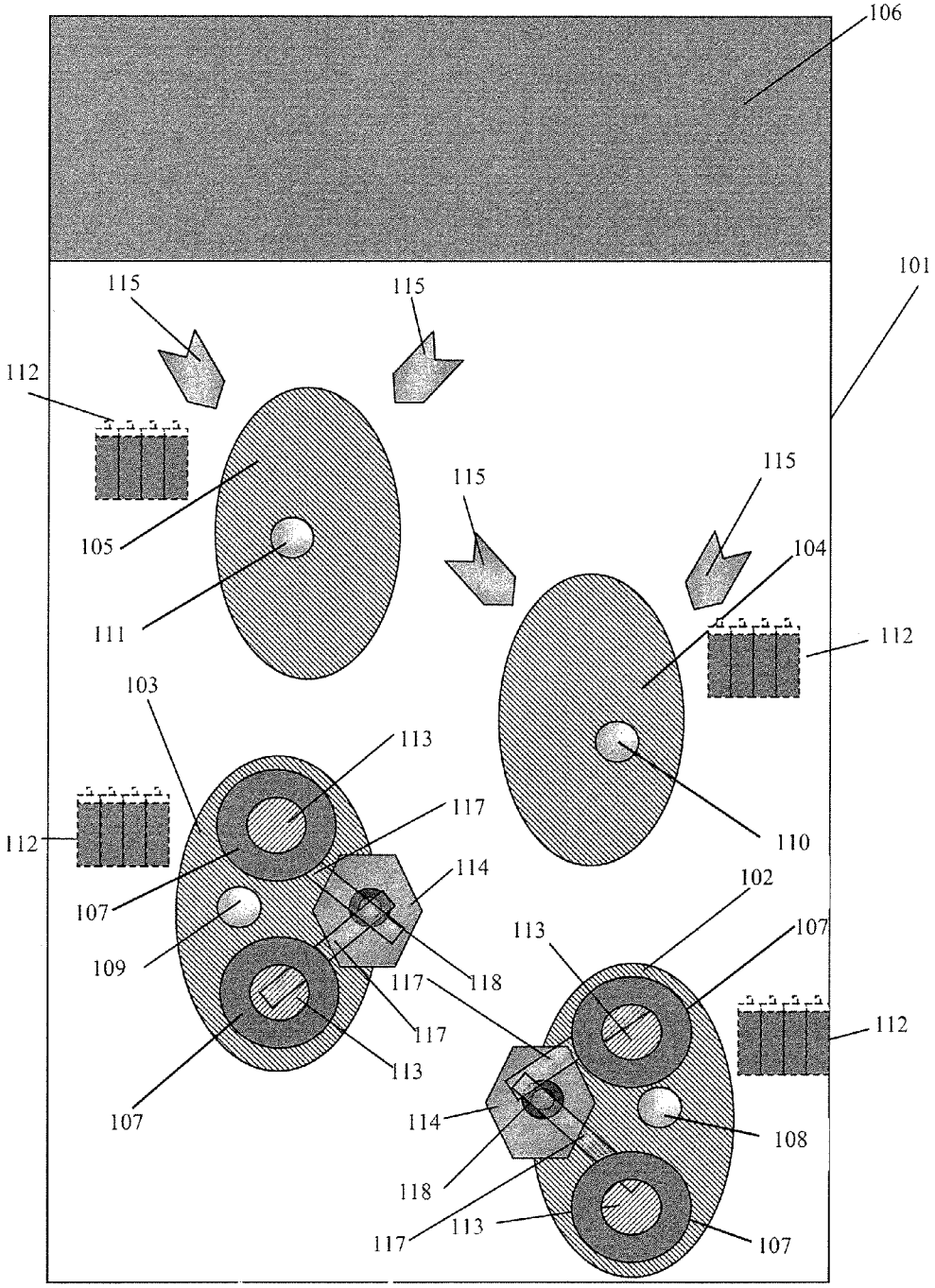
FIGS. 1A and 1B are schematic views of an exemplary cleaning doormat.
Figure 1B:
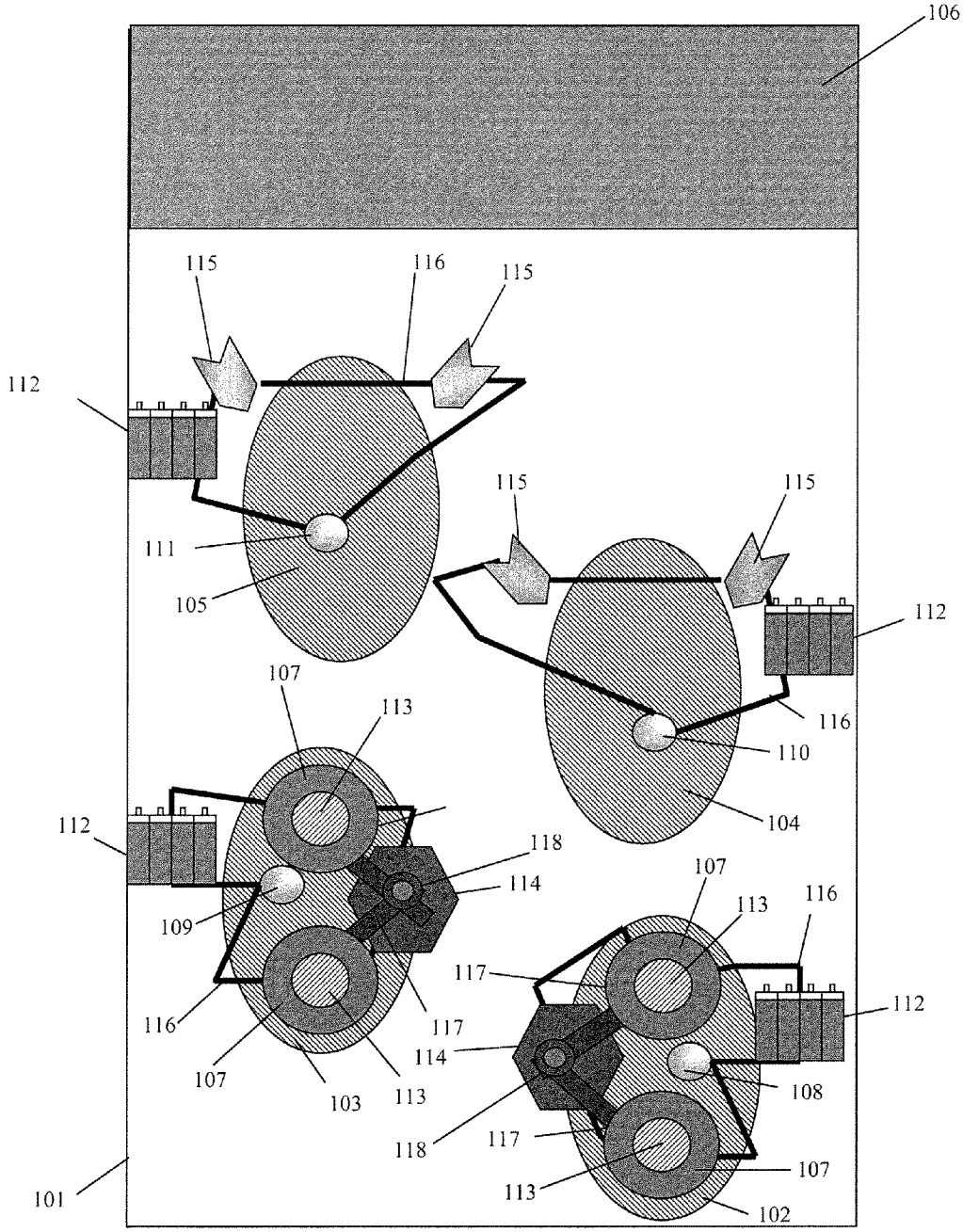

FIGS. 1A and 1B illustrate an exemplary embodiment, showing the doormat and some of the components and connections between them. Doormat 101 includes a sanitizing stage comprising an area for one to place the right foot 102, and an area to place the left foot 103. A user would place his or her right foot on 102 and left foot on 103, thereby depressing button 108 with the right foot and button 109 with the left foot. This activates pumps 118 to pump cleaning fluid from cleaning fluid reservoirs 114, through tubes 117, into sponges 107. The cleaning fluid may be antibacterial, a disinfectant, a detergent, water, an alcohol, a solvent, or any other type of cleaning fluid appropriate for the cleaning of footwear. Depressing buttons 108 and 109 also causes current to flow from battery packs 112 to motors 113 (attached to the lower surface of the sponge, therefore, not visible by looking at the top of the device). This causes sponges 107 to rotate, thereby physically cleaning the footwear and applying cleaning fluid to the footwear of the individual using the mat.

This example doormat uses "push-to-make" switches, such that when the button is pressed current flows from a battery pack to a portion of the doormat requiring power to operate. When the switch is released, current ceases to flow and the portion of the doormat is deactivated. In other embodiments, current may continue to flow for a set period of time after the switch is released or for a set period of time once the switch is activated. Other types of switches or buttons that allow for hands free operation could be used, including, but not limited to, pressure sensors, buttons, switches, motion sensors, or optical sensors. For example, in one embodiment, a light source emitting a beam of light and detector are mounted on one side of the mat, aligned with the right foot cleaning stage area 102. A reflector is mounted on the opposite side, such that when a person stepped onto the mat, the beam of light is interrupted, thereby activating the doormat.

Other types of activation mechanisms can be used to turn on the doormat. For example, a single button 108 can be used to activate the doormat by stepping with the right foot. This activates a timed cleaning cycle wherein the right foot and left foot are cleaned in the cleaning stage for a predetermined amount of time. The timing cycle may also include the drying steps described below, such that the footwear is dried for a predetermined amount of time. This time can be adjusted as needed for the desired level of cleaning. This can also be adjusted depending on the addition of optional supplemental cleaning and supplemental drying stages. In some embodiments, the user may adjust the time of cleaning as necessary, or may set the programming for a preset cleaning cycle.

In some embodiments, doormat 101 is approximately 3 inches in height. For any particular implementation, the height of the doormat will depend on the components used and the type of footwear to be cleaned. For heavier duty cleaning, larger and more powerful components may be used. Some embodiments of the doormat are also larger with recessed cleaning and drying stages, allowing for the cleaning of footwear such as boots. Some embodiments of the doormat may be up to about 12 inches in height.

As depicted, the sponges 107 are positioned to clean the bottom of footwear. In this embodiment, the sponges 107 are shaped like discs and rotate along an axis perpendicular to the ground. Other sponge configurations can also be used, including, but not limited to, cylindrical sponges configured to rotate along an axis parallel to the ground. Sponges can be different shapes and move in different manners to clean, including, but not limited to, rotating, back and forth movement, oscillation, vibration, and combinations thereof. This disclosure contemplates these configurations, as well as similar ones and is not intended to be limited to the specifically disclosed embodiments.

In other embodiments, and as described further below, the sponges clean other portions of the footwear besides the bottom. For example, sponges can also be oriented in other manners to achieve further cleaning of the upper and side portions of footwear. For example, further sponges may be oriented around the perimeter of right and left foot placement areas, 102 and 103, allowing for side cleaning action. Sponges may also be positioned to clean the upper portions of footwear.

After the shoes have been cleaned, the individual enters the drying stage comprising an area for one to place the right foot 104, and an area to place the left foot 105. A person would place his or her right foot on drying area 104 and left foot on drying area 105, thereby depressing button 110 with the right foot and button 111 with the left foot. Depressing buttons 110 and 111 allows current to flow from battery packs 112 to fans 115, thereby drying the footwear. In embodiments utilizing preset or programmed cleaning cycles, one or both of buttons 110 and 111 may be omitted.

The drying stage can utilize a variety of different drying devices to dry the footwear. The drying stage may use a vacuum, heater, fan, infrared light, ultraviolet light, or other drying mechanism, depending on the desired application. In other embodiments, the drying stage utilizes mechanical drying mechanisms, such as dry rotating sponges, terry cloth, or microfiber cloth to physically wipe and remove moisture from the shoes. The drying stage may either be activated for as long as someone is standing in it, or it may be set to dry for a predetermined time.

Optional supplemental drying area 106 comprises a drying material, such as, but not limited to, terry cloth or microfiber, which would allow a person using the device to remove any remaining cleaning fluid, particularly from the bottom of the footwear. This supplemental drying area may be detachable and machine washed.

While this particular embodiment utilizes battery power, the mat can also be configured to be plugged into a wall socket or other sources of power, such as solar power for outdoor applications of the doormat.

Some embodiments further comprise a shoe buffer and/or a shoe polisher positioned after the drying area or the supplemental drying area.

As depicted in FIG. 1B, wires 116 connect the motors 113 which are attached to sponges 107. The flow of current between the motors 113 and sponges 107 is controlled by buttons 108 and 109. Depressing buttons 108 and 109 completes the circuit and causes current to flow from battery packs 112 to motors 113 thereby causing sponges 107 rotate. This serves to physically clean the footwear and apply cleaning fluid to the footwear of the individual using the mat. Wires 116 connect fans 115 to battery packs 112. When activated, the fans dry the footwear.

Figure 2A:
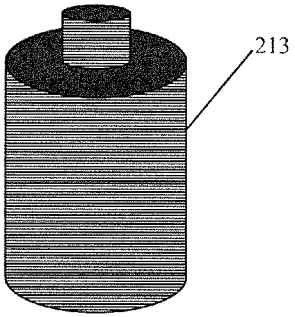
FIGS. 2A and 2B illustrate a sponge and associated motor for use with the cleaning doormat.
Figure 2B:
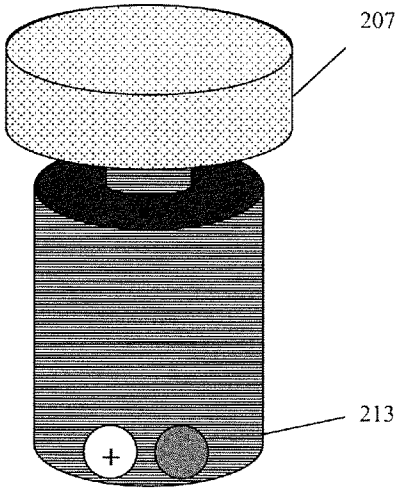

FIGS. 2A and 2B show an exemplary sponge and motor that can be used in the instant invention. In FIG. 2A, sponge 207 is depicted separated from motor 213, such as for cleaning or replacing sponge 207. In FIG. 2B, sponge 207 is depicted attached to motor 213, ready for use. In this embodiment, activation of motor 213 causes sponge 207 to rotate. In alternative embodiments, an indirect coupling between motor 213 and sponge 207 may be used, allowing sponge 207 to rotate, oscillate, or otherwise move so as to clean a user's footwear.

Figure 3A:
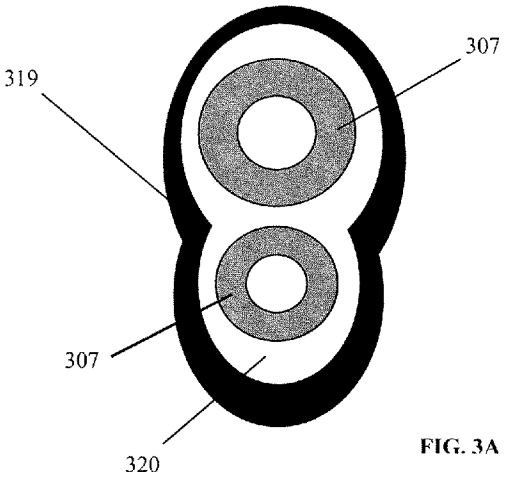
FIGS. 3A and 3B illustrate exemplary foot support areas.
Figure 3B:
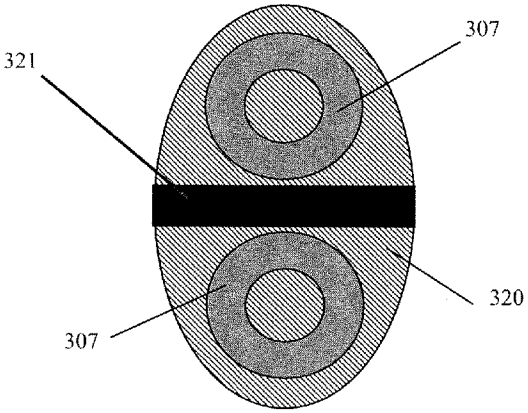

Foot placement areas 102 and 103 include support areas, as illustrated in FIGS. 3A and 3B, around sponges 107, so that the bulk of the user's weight does not press on sponges 107 and the rotation of sponges 107 does not make standing or balancing on foot placement areas 102 and 103 difficult. FIG. 3A depicts an embodiment wherein 319 is an outer rim support area surrounding the foot placement area 320. 319 is shaped so that the bulk of the user's weight presses on the outer rim support area, allowing sponges 307 to rotate freely and clean the bottom part of the footwear.

FIG. 3B depicts another embodiment wherein the support area 321 is a horizontal surface mounted between sponges 307. The bulk of a user's weight would rest on the support area, allowing for proper cleaning of the bottom of the footwear. In light of this disclosure, one of skill in the art could configure the support areas to clean particular desired areas of the shoe. Furthermore, if a supplemental cleaning stage is used, such as in the embodiment depicted in FIG. 5, different configurations could be utilized in the cleaning stage and the supplemental cleaning stage, allowing for through cleaning of the lower surfaces of the footwear.

Figure 4:
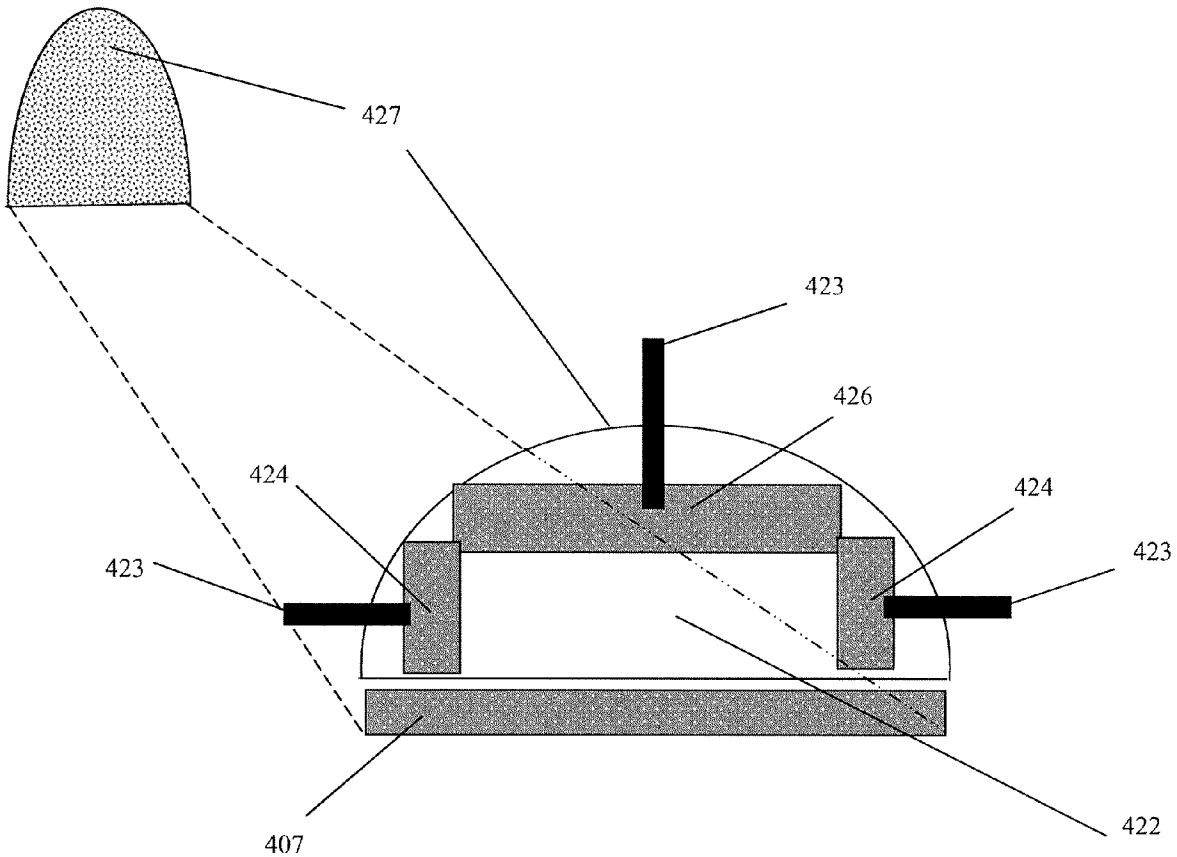
FIG. 4 illustrates an exemplary adjustable auxiliary cleaning apparatus that cleans the top and sides of footwear.

In some embodiments, the sponge positions can be adjusted, such as for cleaning footwear of different sizes. Adjustments can be done manually, or in some embodiments, the sponges automatically adjust to account for the size of footwear placed in the cleaning stage. FIG. 4 represents a cutaway of an exemplary top and side cleaning sponge configuration. External casing 427 encloses the cleaning apparatus. The footwear would be inserted toe first into opening 422. The size of this opening can be fixed, or it can be adjustable. Sponge 407 is configured to clean the bottom of footwear, and may be the same or similar to sponge 107 in FIG. 1. Sponges 424 are configured to clean the sides of footwear. Sponge 426 is configured to clean the top of footwear. Screws 423 permit adjustment of the position of and/or tension on the sponges to ensure proper cleaning of many sizes and style of shoes. Instead of screws, springs, or other mechanical devices may be used to adjust the sponges.

Figure 5:
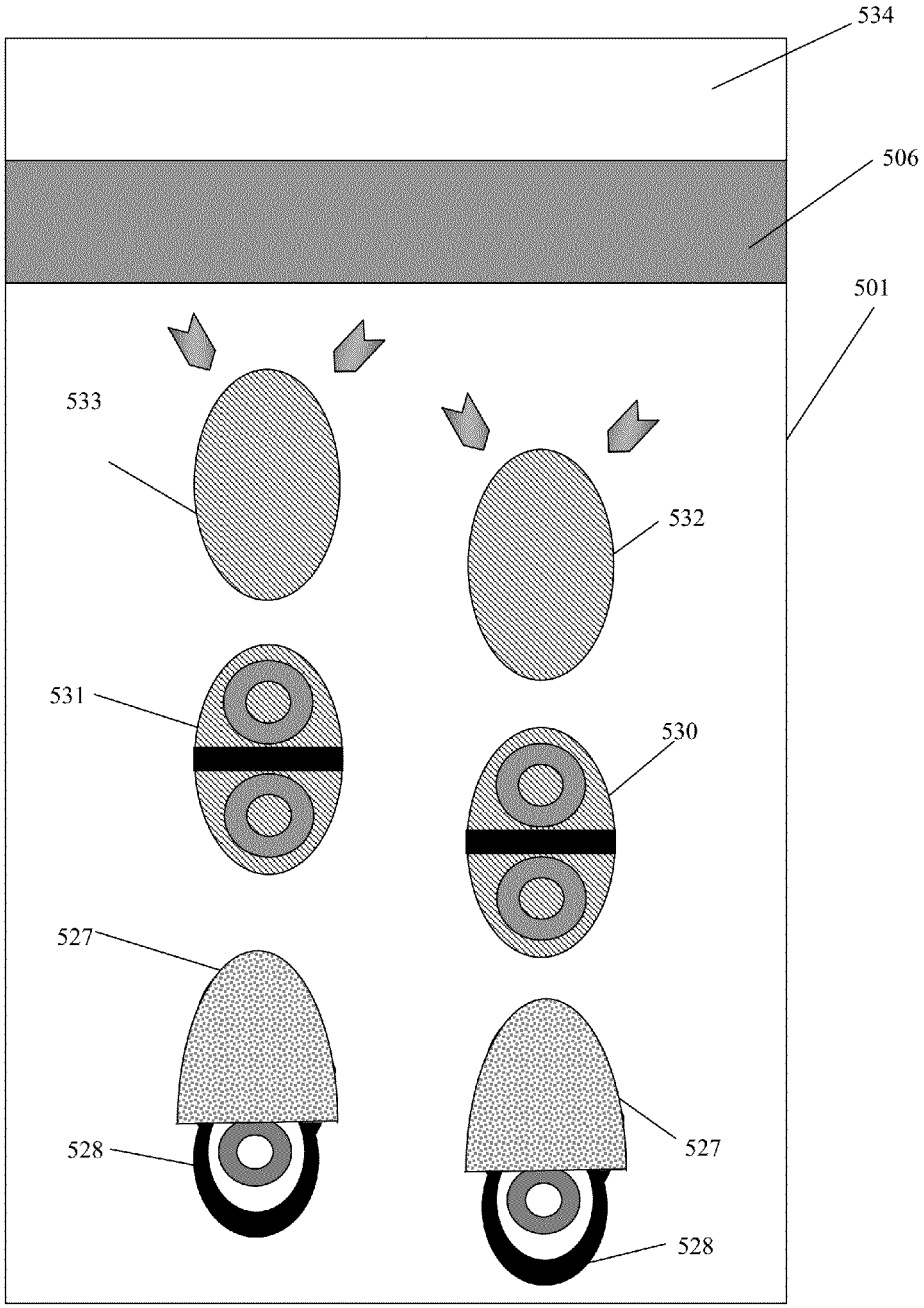
FIG. 5 illustrates an exemplary doormat further comprising a supplemental cleaning stage.

Some embodiments further comprise an optional supplemental cleaning stage, such as depicted in FIG. 5. This would allow for further cleaning as needed. FIG. 5 depicts an embodiment wherein the cleaning stage is made up of an area to place the right foot 528 and an area to place the left foot 529, both with an outer rim support area as depicted in FIG. 3A. The cleaning stage also includes a cleaning apparatus for each foot 527 such as that described in FIG. 4.

The supplemental cleaning stage is made up of an area to place the right foot 530, and an area to place the left foot 531, both configured with a horizontal support area as depicted in FIG. 3B. This allows for the entire bottom of the shoe to be cleaned by the doormat. In some embodiments, the supplemental cleaning stage may be configured like the cleaning stage, but with the supportive area and/or sponges positioned differently to ensure that the entire sole of the shoe is cleaned. In other embodiments, a first cleaning fluid may be used in the cleaning stage, while a second cleaning fluid may be used in the supplemental cleaning stage. For example, a detergent may be used in the cleaning stage, while water may be used in the supplemental cleaning stage to remove any soap residue. In some embodiments, different types of sponges are used in the cleaning stage and in the supplemental cleaning stage. For example, sponges may have different textures or degrees of firmness, allowing for more customizable cleaning, depending on the degree of cleaning desired, the setting for the doormat, and the type of footwear being cleaned. Finally, the embodiment depicted in FIG. 5 also contains a drying stage as described earlier, made of an area to place the right foot 532 and an area to place the left foot 533. This embodiment also contains drying cloth area 506 and optional shoe buffing station 534.

Although the present disclosure has been described and illustrated in the foregoing example embodiments, it is understood that the present disclosure has been made only by way of example, and that numerous changes in the details of implementation of the disclosure may be made without departing from the spirit and scope of the disclosure, which is limited only by the claims that follow.

The invention claimed is:

1. A hands free footwear cleaning device for cleaning footwear comprising:

a. a cleaning stage for cleaning a top, side and bottom of a first shoe and a second shoe while worn comprising:

a first plurality of sponges movably coupled to at least one first motor, positioned such that the first plurality of sponges includes a first portion of sponges configured for cleaning the top of the first shoe, a second portion of sponges configured for cleaning the side of the first shoe, and a third portion of sponges configured for cleaning the bottom of the first shoe;

a second plurality of sponges, distinct from the first plurality of sponges, movably coupled to at least one second motor, positioned such that the second plurality of sponges includes a first portion of sponges configured for cleaning the top of the second shoe, a second portion of sponges configured for cleaning the side of the second shoe, and a third portion of sponges for cleaning the bottom of the second shoe;

at least one first reservoir to support a supply of a first cleaning fluid to said first and second plurality of sponges;

at least one pump for pumping said first cleaning fluid from the at least one reservoir to said first and second plurality of sponges;

at least one activation mechanism, wherein the at least one activation mechanism causes said first cleaning fluid to be pumped by the at least one pump into said first and second plurality of sponges;

b. a supplemental cleaning stage for cleaning the top, side and bottom of the first shoe and the second shoe while worn, the supplemental cleaning stage being positioned after the cleaning stage, wherein the supplemental cleaning stage comprises:

a third plurality of sponges movably coupled to at least one third motor, positioned such that the third plurality of sponges includes a first portion of sponges configured for cleaning the top of the first shoe, a second portion of sponges configured for cleaning the side of the first shoe, and a third portion of sponges configured for cleaning the bottom of the first shoe;

a fourth plurality of sponges, distinct from the third plurality of sponges, movably coupled to at least one second motor, positioned such that the fourth plurality of sponges includes a first portion of sponges configured for cleaning the top of the second shoe, a second portion of sponges configured for cleaning the side of the second shoe, and a third portion of sponges for cleaning the bottom of the second shoe;

at least one supplemental reservoir to support a supply of a second cleaning fluid to said third and fourth plurality of sponges; and at least one supplemental pump for pumping said second cleaning fluid from the at least one supplemental reservoir to said third and fourth plurality of sponges; and c. a drying stage comprising at least one drying device.

2. The device of claim 1 having only one activation mechanism, wherein the activation mechanism triggers a preset timed cleaning and subsequent drying stage.

3. The device of claim 1 wherein the cleaning stage includes a first supporting area and the supplemental cleaning stage includes a second supporting area, and wherein the second supporting area is configured with a different arrangement than the first supporting area.

4. The device of claim 1 wherein the at least one first reservoir contains a first type of cleaning fluid and the at least one supplemental reservoir contains a second type of cleaning fluid.

5. The device of claim 4 wherein the first type of cleaning fluid includes a detergent and the second type of cleaning fluid is water.

6. The device of claim 1 further comprising a shoe buffing station.

7. The device of claim 1 wherein the drying device includes a fan.

8. The device of claim 1 wherein the at least one activation mechanism includes a pressure sensor.

9. The device of claim 1 further comprising a supplemental drying stage.

10. The device of claim 9 wherein the supplemental drying stage comprises a drying cloth.

11. The device of claim 1 wherein the first or second cleaning fluid includes a disinfectant.

12. The device of claim 1 wherein the first or second cleaning fluid is antibacterial.

13. The device of claim 1, further comprising a solar power cell to power the device.

14. The device of claim 1 wherein the at least one activation mechanism can be triggered without the use of hands.

15. The device of claim 1 wherein the device is about 12 inches tall or less.

16. The device of claim 1 wherein the device is about 3 inches tall.

* * * * *